US007955117B2

(12) United States Patent
Nolting et al.

(10) Patent No.: US 7,955,117 B2
(45) Date of Patent: Jun. 7, 2011

(54) CONNECTOR ARRANGEMENT FOR FLAT CONDUCTORS

(75) Inventors: Reinhard Nolting, Detmold (DE); Torsten Feige, Bielefeld (DE); Frank Hackemack, Detmold (DE); Klaus Pueschner, Detmold (DE); Joerg Richts, Schlangen (DE); Klaus Wohlgemuth, Kalletal (DE)

(73) Assignee: Weidmueller Interface GmbH & Co. KG, Detmold, DE (US)

( * ) Notice: Subject to any disclaimer, the term of this patent is extended or adjusted under 35 U.S.C. 154(b) by 0 days.

(21) Appl. No.: 12/635,740

(22) Filed: Dec. 11, 2009

(65) Prior Publication Data

US 2010/0159738 A1 Jun. 24, 2010

(30) Foreign Application Priority Data

Dec. 19, 2008 (DE) ..... 20 2008 016 800 U

(51) Int. Cl.
*H01R 4/26* (2006.01)

(52) U.S. Cl. ..... 439/433; 439/411

(58) Field of Classification Search ..... 439/411, 439/412, 431, 433, 801, 810
See application file for complete search history.

(56) References Cited

U.S. PATENT DOCUMENTS

| | | | | |
|---|---|---|---|---|
| 3,146,053 | A | 8/1964 | Strock | |
| 4,971,573 | A * | 11/1990 | Pinyan | 439/412 |
| 5,087,206 | A * | 2/1992 | Jaenke et al. | 439/92 |

FOREIGN PATENT DOCUMENTS

| | | |
|---|---|---|
| DE | 29901299 U1 | 6/1999 |
| JP | 4998785 | 8/1974 |
| JP | 6340273 | 2/1988 |

* cited by examiner

*Primary Examiner* — Khiem Nguyen
(74) *Attorney, Agent, or Firm* — Lawrence E. Laubscher, Sr.; Lawrence E. Laubscher, Jr.

(57) ABSTRACT

A connector arrangement includes a flat conductor component having a flat engagement portion, a conductive bus bar component having a flat engagement portion, and a conductive contact screw connecting the conductor and bus bar flat engagement portions in contiguous surface-to-surface electrical engagement. The contact screw has a pointed tip and is axially displaceable from a retracted position normal to and spaced from the flat conductor and bus bar engagement portions toward a connected position in which a pointed end of the screw penetrates or extends through openings in the bus bar and flat conductor engagement portions, and into a bore contained in a housing support surface. The housing support surface supports the flat engagement portions in either a horizontal orientation or a slightly inclined orientation relative to the horizontal upper surface of electrical panel component to which the flat conductor is connected and upon which the housing is mounted.

20 Claims, 8 Drawing Sheets

Fig.2a
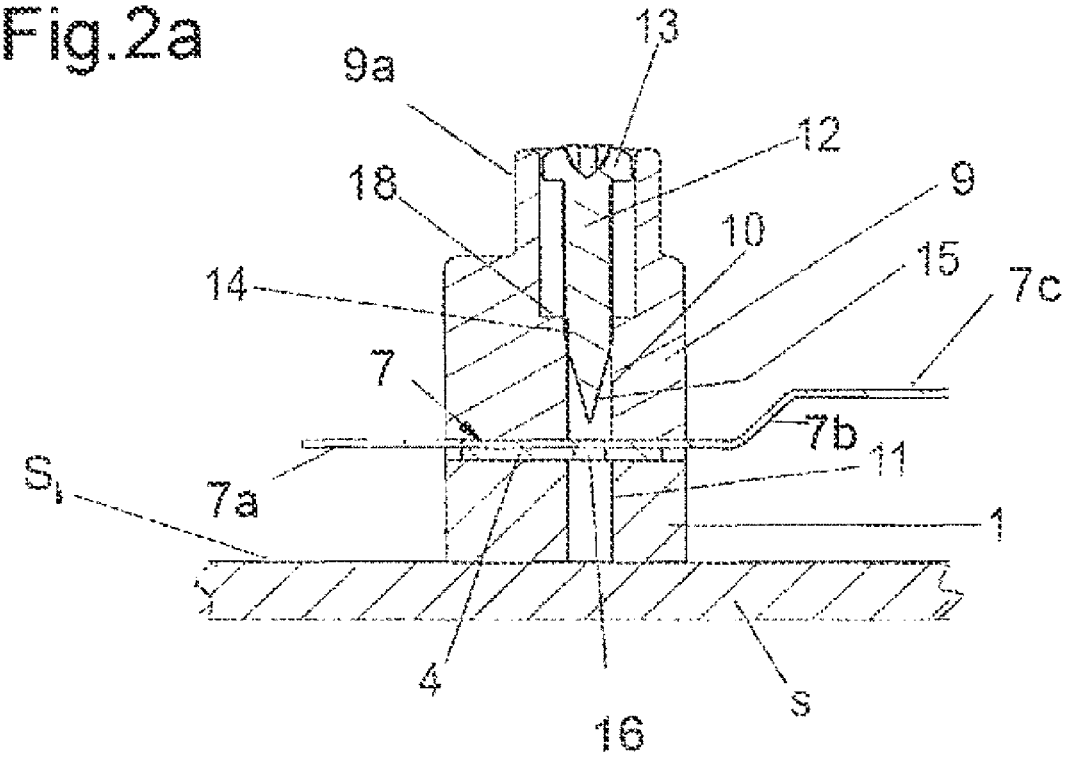
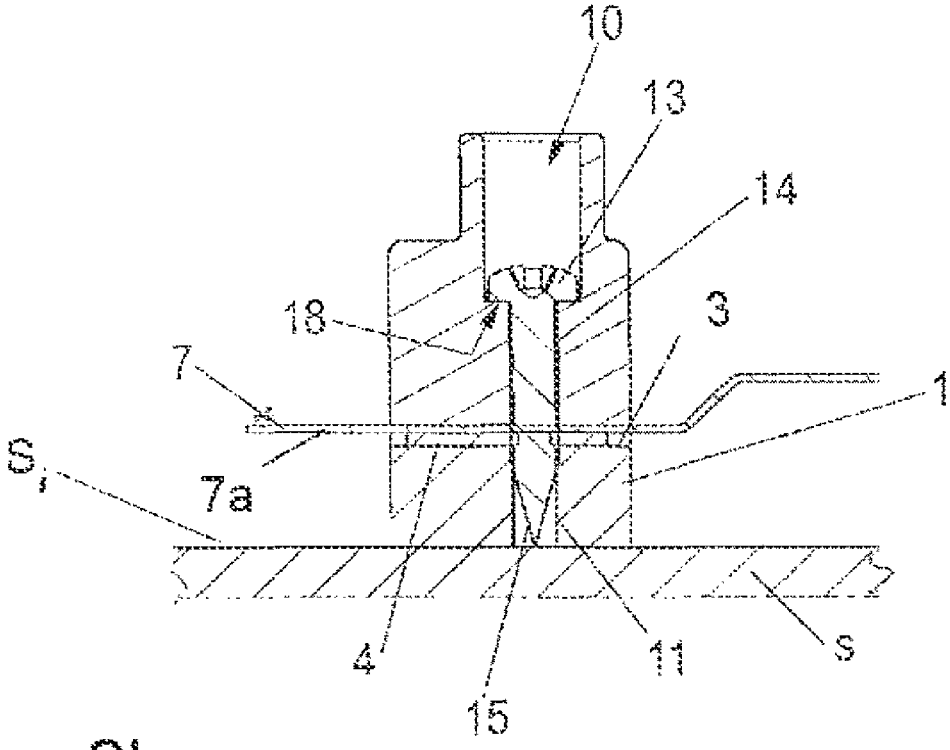
Fig. 2b

Fig. 4a
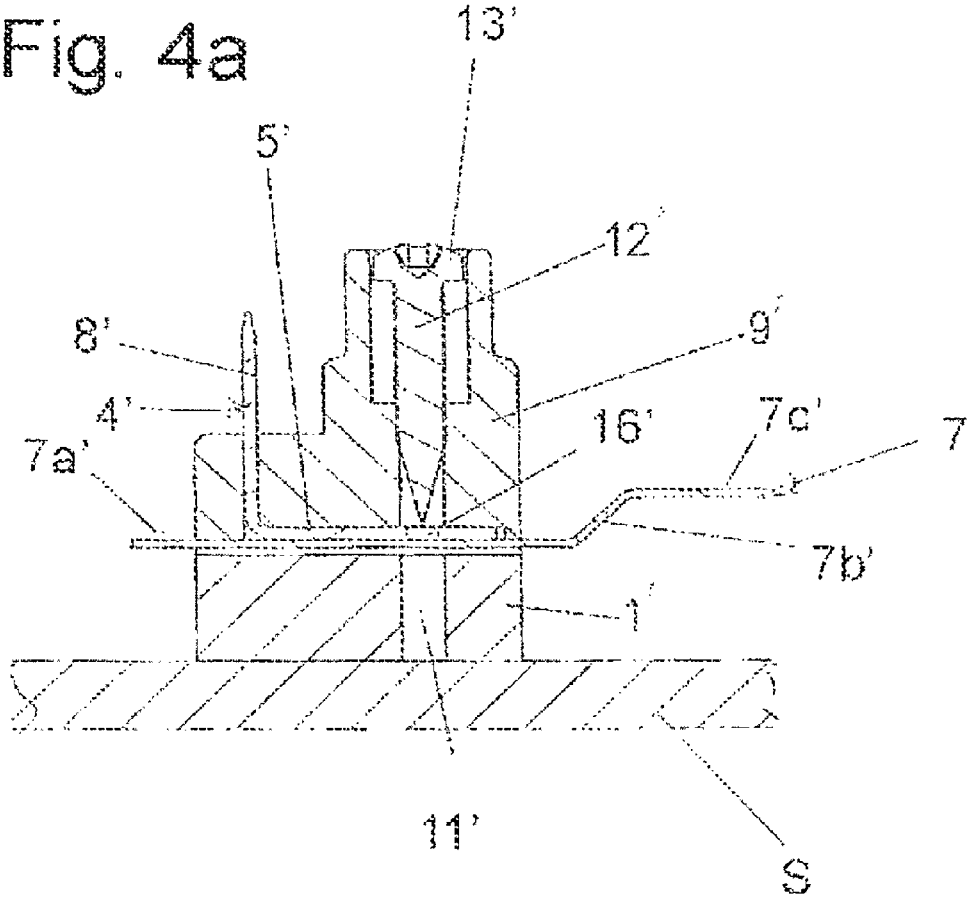
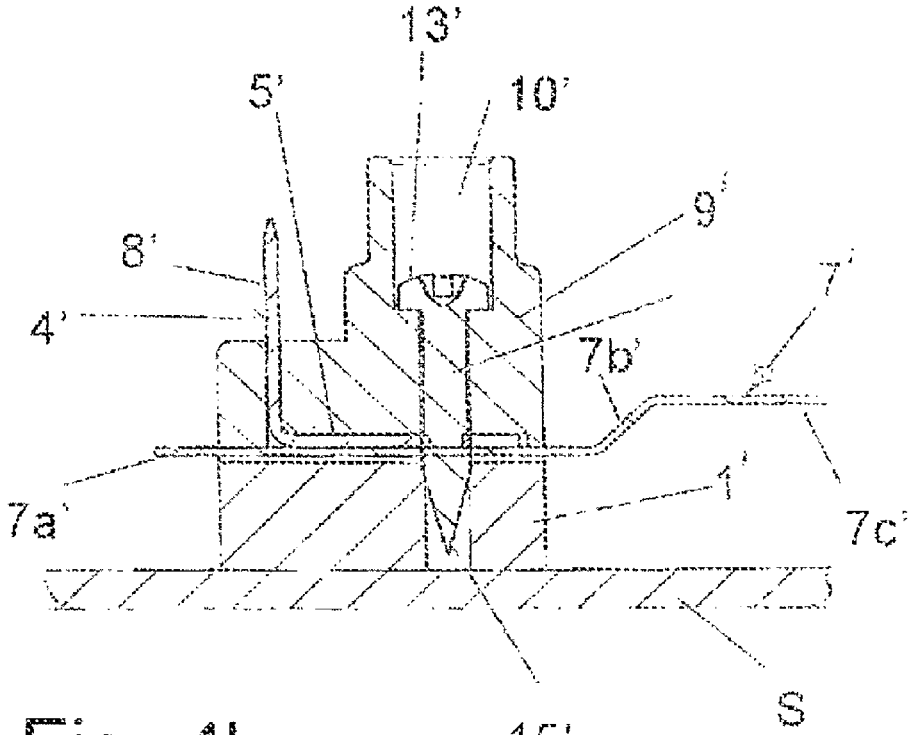
Fig. 4b

Fig. 6a
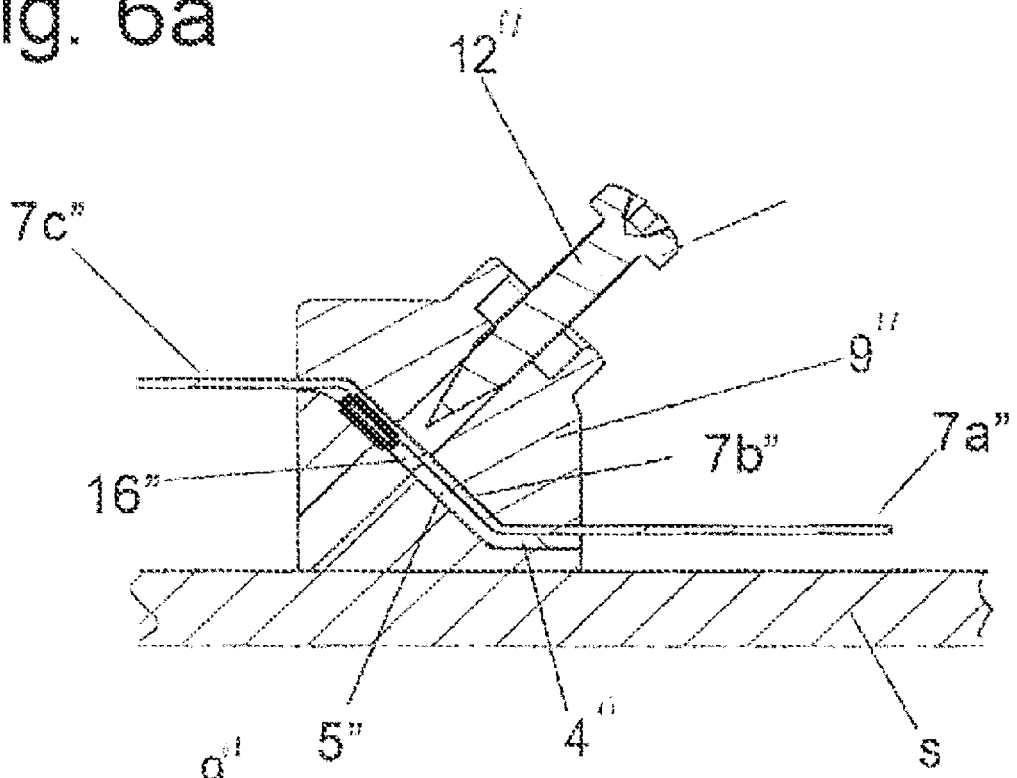
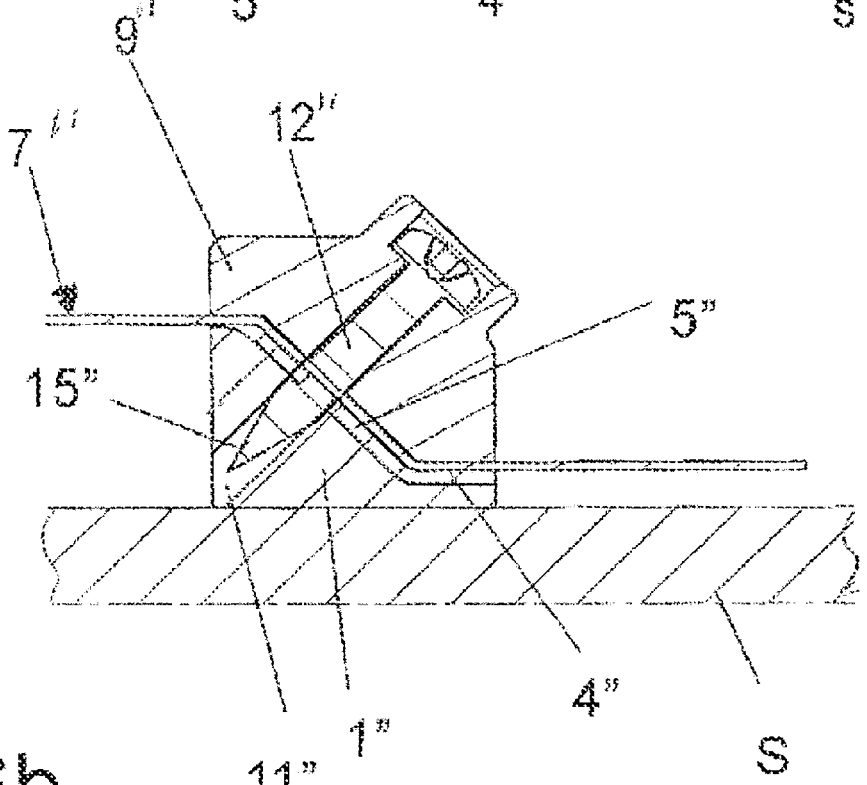
Fig.6b

Fig. 8a
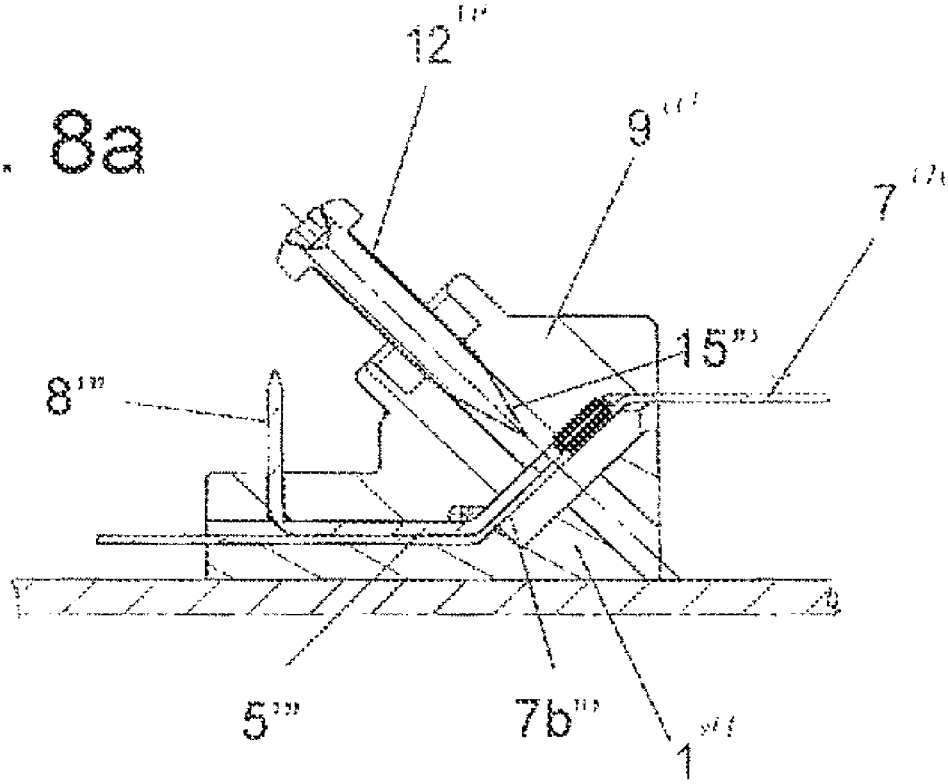
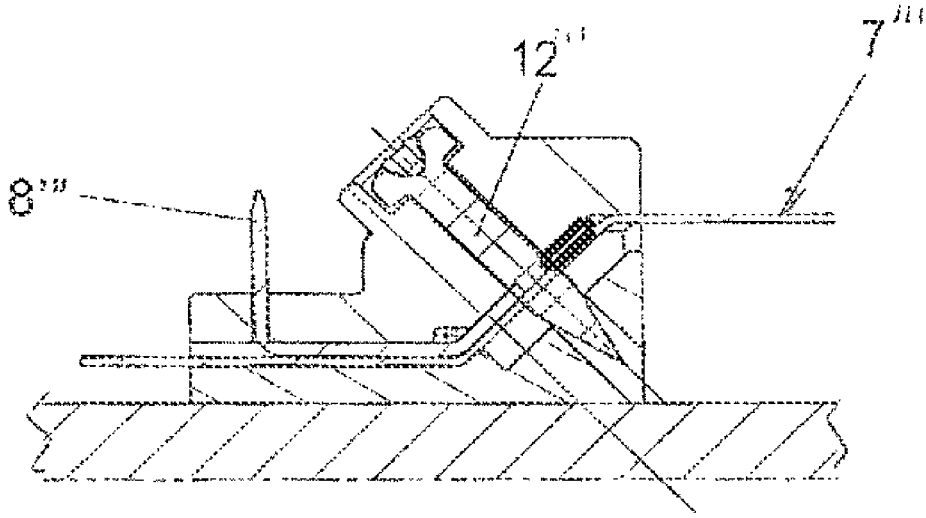
Fig. 8b
5''

CONNECTOR ARRANGEMENT FOR FLAT CONDUCTORS

BACKGROUND OF THE INVENTION

1. Field of the Invention

A connector arrangement includes a flat conductor component having a flat engagement portion, a conductive bus bar component having a flat engagement portion, and a conductive contact screw connecting the conductor and bus bar flat engagement portions in contiguous surface-to-surface electrical engagement. The contact screw has a pointed tip and is axially displaceable from a retracted position normal to and spaced from the flat conductor and bus bar engagement portions toward a connected position in which a pointed end of the screw penetrates or extends through openings in the bus bar and flat conductor engagement portions, and into a bore contained in a housing support surface.

2. Description of Related Art

It has proven to be difficult in the prior art to make electrical connection with the flat conductor leading to an electrical panel, such as a solar panel generating a photovoltaic current, or a printed circuit board. Many different solutions have been proposed in the prior art for improving the connection with the flat conductors. Generally, it has been proposed to contact the associated end of the flat conductor by means of a contact spring.

Contrary to the proposals of the prior art, it has been determined to take another route, and to provide an electrical connection to the relatively delicate flat conductor by means of a penetrating contact screw having a pointed end for piercing the flat conductor and for connecting the same in contiguous surface-to surface contact with a bus bar.

SUMMARY OF THE INVENTION

Accordingly, a primary object of the present invention is to provide an electrical connector arrangement wherein a flat conductor and a bus bar have parallel flat engagement portions that are in surface to surface engagement, and that a contact screw extends through the engagement portions to effect a positive electrical connection.

According to a more specific object of the invention, a sectional housing is provided having a base portion carrying support surfaces for supporting the flat engagement portions of the bus bar and the flat conductor. A cover section is provided with a threaded bore normal to the support surfaces for supporting a contact screw normal to the support surfaces. The contact screw has a pointed tip, so that when the contact screw is rotated and axially displaced from a retracted position toward a connected position, the pointed tip is caused to pierce and penetrate the flat conductor, and to extend through a pilot hole formed in the bus bar engagement portion.

A further object of the invention is to provide a connector arrangement wherein a flat conductor is arranged upon a bus bar, where the connection device has a contact screw that presses the conductor, especially the flat conductor and the bus bar upon each other in a contacting manner, and which passes through the conductor, especially the flat conductor and the bus bar in the contacted state. The contact screw passes through and preferably penetrates the conductor, in particular, the flat conductor, like a piercing screw. Moreover, however, it presses the bus bar and flat conductor elements upon each other and in this way ensures such a contact between these elements that a particularly good electrical contact can be assured.

The invention is especially suitable for relatively-delicate thin flexible flat conductors. The concept of bus bar should not be construed too narrowly. It comprises, on the one hand, conducting bars, but also conductors of a different kind against which the conductor that is to be contacted is pressed.

The connection device is advantageously supplemented by a connection housing to receive the bus bar, the flat conductor, and the contact screw, which is used to retain and guide the contact screw and which preferably also constitutes a contact rest for the bus bar and the flat conductor.

The connection housing can also be used to receive and connect several of the bus bars, of the flat conductors, and of the contact screws. To that extent, all claims relate to one or several of the bus bars, the flat conductors, and the contact screws.

It is advantageous when the connection housing has a base for the placement of at least one bus bar and of at least one flat conductor, and furthermore, it is advantageous when it has a cover strip that can be fixed upon the base in order to receive the metal parts of the connection device.

According to a particular variant, it is provided that the flat conductor rest upon the bus bar and that the contact screw, during contacting, first of all passes through the flat conductor and then through the bus bar. In case the flat conductor consists of flexible material, it is particularly advantageous to employ a variant according to which the flat conductor is pressed firmly against the bus bar, and under certain circumstances, if it is even pressed all the way into the area of a passage borehole of the bus bar, which will assure a particularly good contact.

As an alternative, the following design is also conceivable: The bus bar rests on the flat conductor and, during contacting, the contact screw first of all passes through the bus bar and then through the flat conductor.

In terms of handling, the invention can thus be implemented with the most widely differing variants. For instance, it is conceivable that the base have an assembly surface for assembly upon a support, such as a surface of a solar collector, and that the contact screw be aligned perpendicularly to the assembly surface when the base is in the assembled position. But to optimize the handling, it is also particularly conceivable that the contact screw—when the base is in the assembled position—be aligned on a support at an acute angle with respect to the assembly surface.

It is practical when the contact screw has a pointed penetration tip, which is so designed that, with its help, one can penetrate at least the material of the flat conductor in a separating or reshaping manner.

The invention also provides a connector arrangement for a solar panel, which has at least one connection device. It is especially suitable for use with solar panels, wherein the contacting of three flat conductor ends often constitutes a particular technical challenge.

BRIEF DESCRIPTION OF THE DRAWINGS

Other objects and advantages of the invention will become apparent from a study of the following specification, when viewed in the light of the accompanying drawing, in which:

FIGS. 2*a* and 2*b* are sectional views of the apparatus of FIG. 1*b* with the contact screw in the retracted and connected positions, respectively;

FIGS. 4*a* and 4*b* are sectional views of the apparatus of FIG. 3*b* with the contact screw in the retracted and connected positions, respectively;

FIGS. 6*a* and 6*b* are sectional views of the apparatus of FIG. 5*b* with the contact screw in its retracted and extended positions, respectively;

FIGS. 8*a* and 8*b* are sectional views of the apparatus of FIG. 7*b* with the contact screw in the retracted and extended positions, respectively.

DETAILED DESCRIPTION OF THE INVENTION

Figures 1A, 1B:
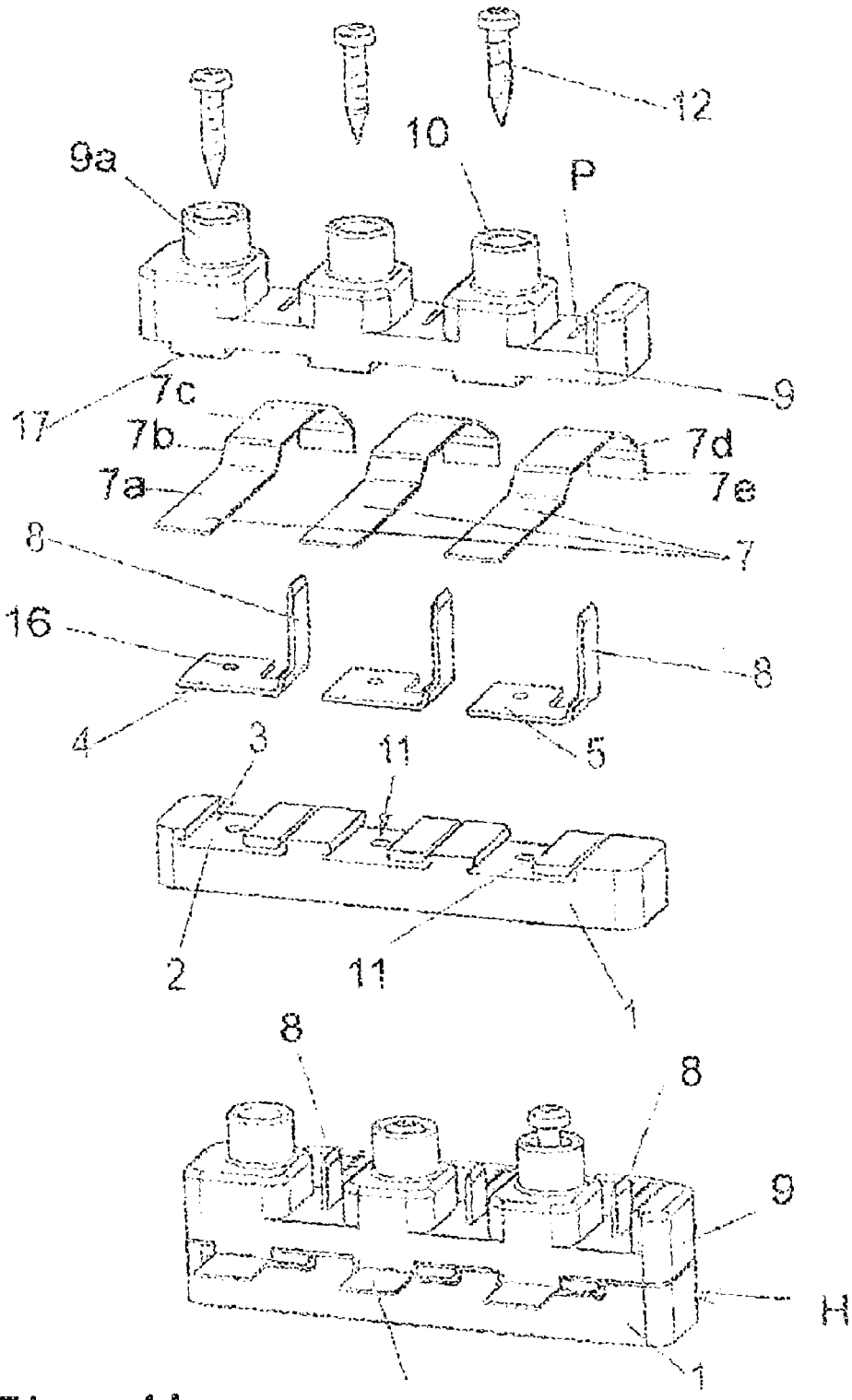
FIGS. 1*a* and 1*b* are exploded and perspective views, respectively, of a first embodiment of the connector assembly of the present invention.

Referring first more particularly to FIGS. 1*a* and 1*b*, the connector apparatus of the present invention includes a generally rectangular housing H having a horizontal base section 1 and an upper cover section 9 that are fastened together by fastener means, such as resilient clip means, screw means, or the like (not shown). The upper surface of the base section contains a plurality of recesses 2 that receive cover alignment projections 17 and define support surfaces 3 for supporting the horizontal engagement portions 5 of conductive L-shaped bus bars 4. The bus bars include orthogonal contact portions 8 that extend vertically upwardly and outwardly of the housing via corresponding slots or openings P contained in the cover section 9. Seated in surface-to-surface contact on the bus bar flat engagement portions 5 are the respective flat engagement end portions 7*a* of a plurality of corresponding relatively-thin flat conductors 7, which end portions extend horizontally outwardly of the housing, as shown in FIG. 1*a*. The other ends 7*e* of the flat conductors are electrically connected with associated circuits provided on the upper surface $S_1$ (FIGS. 2*a* and 2*b*) of an electrical panel component S (such as, for example, a photovoltaic solar panel, a printed circuit board, or the like). The base section 1 is adhesively secured to the upper surface $S_1$ of the electrical panel.

The upper portion of the cover section 9 includes a plurality of upwardly extending cylindrical portions 9*a* that contain vertical though bores 10 in which are threadably connected the threaded body portions of conductive contact screws 12. At their lower ends, the contact screws are provided with pointed penetrating tip portions 15, and at their upper ends, the screws have enlarged head portions 13. The screws are rotated by a screwdriver or the like and are axially displaceable downwardly from the retracted position of FIG. 2*a* toward the connected position of FIG. 2*b*. During this downward displacement of the contact screw, the pointed tip portion 15 penetrates the relatively thin flat conductor engagement portion 7*a*, extends through a pilot hole 16 contained in the bus bar base portion 5, and into an aligned bore 11 contained in the support surface 3 of the base section 1. The flat conductor engagement portion 7*a* is forced by screw 12 into tight electrical engagement with the adjacent surface of the flat conductor engagement portion 7*a*, the engagement portions of the bus bar and the flat conductor being supported by the associated support surface 3 of the base section 1. As shown in FIGS. 2*a* and 2*b*, the bore hole 10 in the cover section is counterbored to define a support seat 18 that supports the screw enlarged head portion 13 of the contact screw when said contact screw is in the fully connected position of FIG. 2*b*. Preferably, the conductive screws 12 are formed from a copper alloy, or the like. The conductive male bus bar contact 8 may be connected with the female contact of a conductor leading to the component that is to be electrically connected with the electrical panel component S.

Figures 3A, 3B:
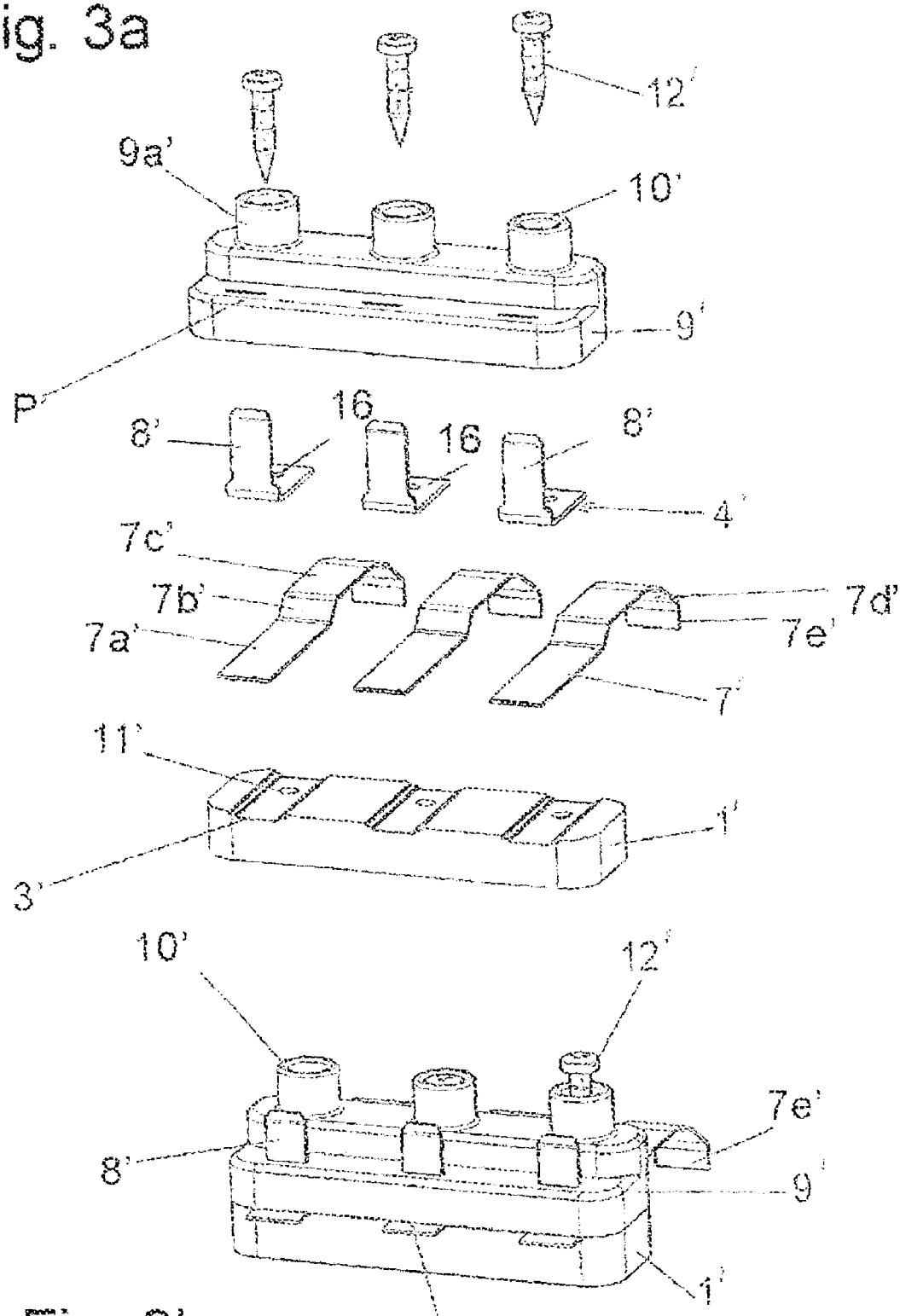
FIGS. 3*a* and 3*b* are exploded and perspective views, respectively, of a second embodiment of the present invention.

Referring now to the connector arrangement of FIGS. 3*a* and 3*b*, instead of having the engagement portion of the flat conductor above the engagement portion of the bus bar, it will be seen that the flat engagement portion 5' of the bus bar 4' may be arranged above the flat engagement portion 7*a*' of the flat conductor 7'. In this case, when the contact screw is rotated by a screw driver or the like and is axially displaced downwardly, the pointed tip 15' successively extends through the pilot opening 16' contained in the horizontal engagement portion 5' of bus bar 4', pierces and penetrates through the relatively thin engagement portion 7*a*' of the flat conductor 7', and extends downwardly into the bore hole 11' contained in the support surface of the housing base section 1'. Thus, the contact screw 12' maintains the engagement portions 5' and 7*a*' of the bus bar and the flat conductor in surface-to-surface electrical engagement.

In the embodiments of FIGS. 2*a* and 4*a*, the contact screw is generally vertical and normal to the electrical panel component S. Referring now to the third embodiment shown in FIGS. 5*a*-6*b*, the screws 12" are arranged at an acute angle relative to the electrical panel component S. In this case, the support surfaces 3" on the base section 1" are angularly arranged relative to the horizontal, for supporting the flat engagement portions 5' of the bus bar 4" and 7*b*" of the flat conductor 7". The aligned bores 10" and 11" of the cover and base sections of the housing are similarly inclined at an acute angle to the horizontal. In the embodiment of FIGS. 5*a*-6*b*, the angularly oriented engagement portions 7*b*" of the flat conductors are arranged above the angularly oriented engagement portions 5" of the bus bars 4", and in the embodiment of FIGS. 7*a*-8*b*, the angularly oriented engagement portions 5'" of the bus bars are arranged above the angularly oriented engagement portions of the flat conductors.

To contact the end of flat conductor 7 or several ends of flat conductor 7, cover strip 9 is separated possibly entirely or somewhat from base 1 and then the end of flat conductor 7 to be contacted or the ends of flat conductor 7 to be contacted and of bus bar 4 are first of all placed directly on top of each other. According to FIG. 1, the ends of flat conductor 7 in each case are placed upon bus bars 4 that rest on base 1 or that is preferably preassembled. The cover section 9 is put on and contact screws 12 are tightened. Contact screws 12 have a preferably designed material penetrating tip 15 that is so designed that at least the material of the flat conductor can be penetrated or pierced by it. Bus bars 4 can either also be pierced by the contact screws, or they may be provided with a pilot borehole 16, which in each case, when the contact screws 12 are screwed in, is penetrated by them in a screwing manner and/or is widened by them, forming screw threads.

In this way, flat conductor 7 with the help of contact screw 12, is pressed against the preferably parallel engagement portion 5 of bus bar 4, and a firm electrical contact is established. This contact is particularly good because contact screw 12, during the separation or cutting of an opening in the flat conductor, so presses the material of flat conductor 7 and of bus bar 4 against each other that, especially in the area of the boreholes or adjoining the area of the boreholes through which the contact screw passes, so that there will be a particularly good electrical contact between the elements "bus bar," on the one hand, and "flat conductor," on the other hand.

This contact can be optimized in the following manner: Contact screw 12 consists of an electrically well-conducting material, especially a light metal, preferably a copper alloy, so that it, by itself, will assume a current-conducting function. Contact screw 12 preferably has a shaping screw thread or cutting screw thread also in the area of the penetration tip 15.

The embodiment in FIGS. 3 and 4 is an alternative to the embodiment in FIGS. 1 and 2; it differs from the design in FIGS. 1 and 2 by virtue of the fact that, first of all, the flat conductors 7 are placed on the bases and, thereafter, the bus bars 4 are placed on the flat conductor 7. Moreover, bus bars 4 have a somewhat different shape than in FIG. 1. Otherwise, the function corresponds to the function given in connection with the exemplary embodiment in FIGS. 1 and 2. Of course, contact screw 12, while establishing the electrical contact, does not penetrate, as in FIGS. 1 and 2, first of all the flat conductor 7 and then the bus bar 4, but, first of all, bus bar 4 and then the flat conductor 7.

According to the exemplary embodiments in FIGS. 1 to 4, support surface 3 in each case is designed parallel to a lower assembly surface of the bases 1.

That is different in FIGS. 5 to 8. There, support surface 3 in each case is aligned along an acute angle of preferably 30°-60° with respect to the assembly surface of the bases 1, something that, for example, might make the work of the assembler easier if the screws 12 are in that way better accessible when compared to the design according to FIGS. 1 to 4.

Figure 5A:
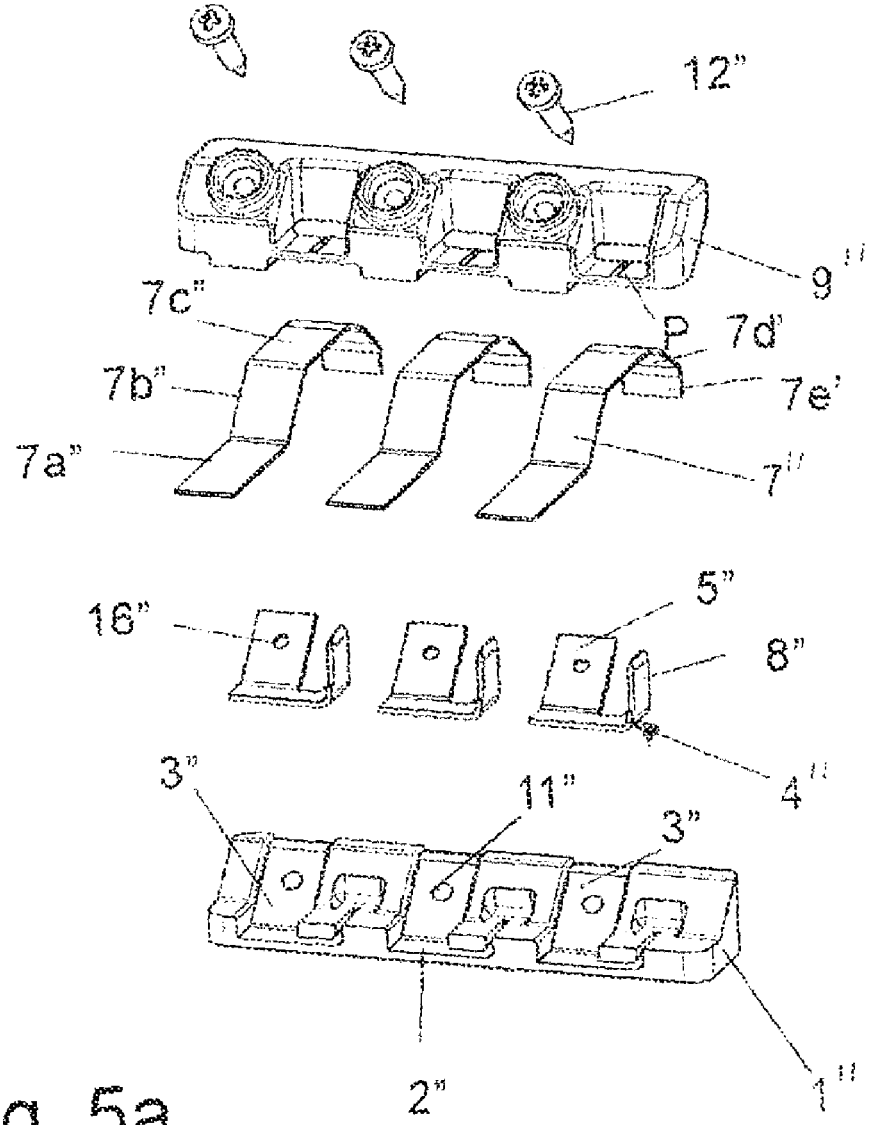
FIGS. 5*a* and 5*b* are exploded and perspective views, respectively, of a third embodiment of the present invention.
Figure 5B:
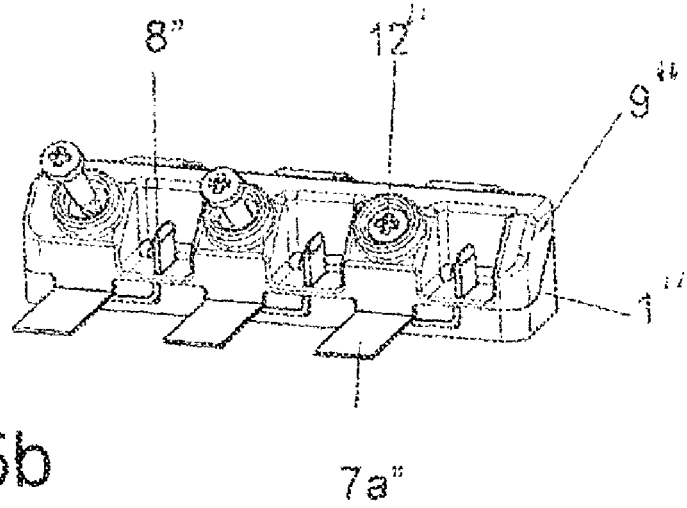

According to the exemplary embodiments in FIGS. 5 and 6, flat conductors 7 again are placed above the bus bars 4 so that, during contacting, first of all the flat conductors 7 and then the bus bars 4 are contacted.

Figure 7A:
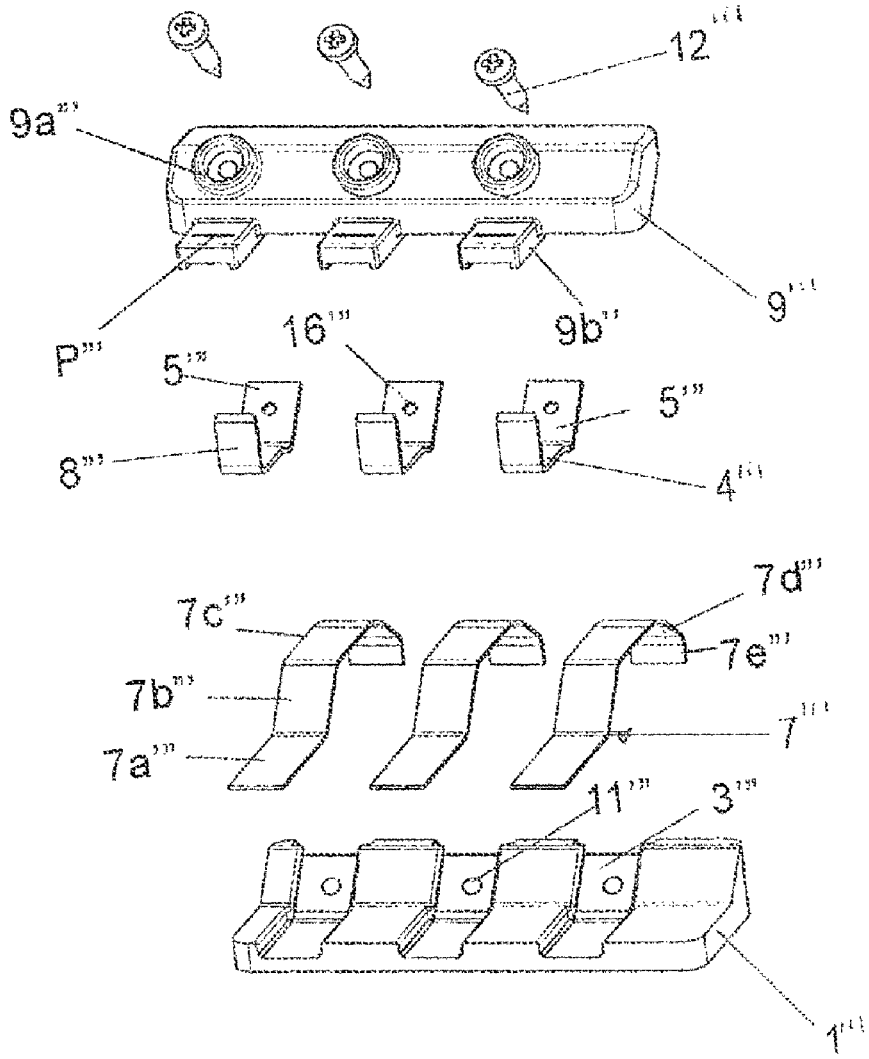
FIGS. 7*a* and 7*b* are exploded and perspective views, respectively, of a fourth embodiment of the invention.
Figure 7B:
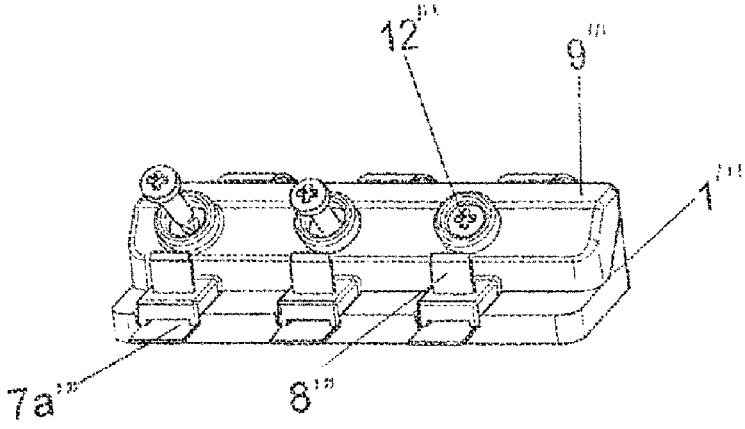

According to the exemplary embodiment in FIGS. 7 and 8, on the other hand, bus bars 4 again are placed above flat conductors 7 so that, during contacting, first of all bus bars 4 and then flat conductors 7 are contacted.

It is in each case advantageous when the flat engagement portions flat conductors 7 and bus bars 4 are made parallel to each other, and when the contact screw, during contacting, is aligned normal to the surface of bus bar 4 and flat conductor 7.

Preferably, but not necessarily, the bus bar 4 and flat conductor 7 do not have the same thickness. It is particularly advantageous when bus bar 4 consists of a material that is thicker than the relatively delicate, flexible flat conductor 7 and/or when the flat conductor 7 is arranged above bus bar 4, because in this way, there is a particularly advantageous contacting between the material of the flat conductor in that way is pressed particularly forcefully into the bus bar.

It is advantageous when the elements contact screw 12, bus bar 4 and flat conductor 7 consist of the same or similar metal alloys.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector arrangement for connecting a flat conductor (7) to a bus bar, comprising:

(a) a flat conductor component (7, 7', 7", 7''') having a flat engagement portion;

(b) a conductive bus bar component (4, 4', 4", 4''') having a flat engagement portion (5, 5', 5", 5''') and a contact portion (8, 8', 8", 8'''); and (c) connecting means including a contact screw (12) for connecting said flat conductor engagement portion in contiguous surface-to-surface electrical engagement with said bus bar flat engagement portion, said contact screw being axially displaceable from a retracted position normal to and spaced from said flat conductor and bus bar engagement portions toward a connected position extending through aligned openings contained in said bus bar and flat conductor engagement portions.

2. A connector arrangement as defined in claim 1, and further including:

(d) housing means (H) having a flat support surface (3, 3', 3", 3''') supporting said bus bar and flat conductor engagement portions, said housing support surface containing a first bore (11) for receiving said contact screw when said contact screw is in said connected position.

3. A connector arrangement as defined in claim 2, wherein said housing means includes a plurality of said flat support surfaces for supporting the engagement portions of a plurality of said bus bar and flat conductor components.

4. A connector arrangement as defined in claim 3, wherein said housing means is sectional and includes a generally horizontal rectangular base section (1) having an upper portion carrying said flat support surfaces, each of said support surfaces containing a first bore.

5. A connector arrangement as defined in claim 4, wherein said housing means includes a cover section (9) mounted on said base section to cover said bus bar and flat conductor engagement portions.

6. A connector arrangement as defined in claim 5, wherein said bus bar engagement portion is seated on said base support surface, and said flat conductor engagement portion is seated on said bus bar engagement portion, and further wherein said contact screw extends successively downwardly through said flat conductor and said bus bar engagement portions.

7. A connector arrangement as defined in claim 5, wherein said flat conductor component engagement portion is seated on said base support surface, and said bus bar engagement portion is seated on said flat conductor engagement portion, and further wherein said contact screw extends successively downwardly through said bus bar and said flat conductor engagement portions.

8. A connector arrangement as defined in claim 5, and further including an electrical panel component (S) having a planar horizontal upper surface ($S_1$) carrying an electrical conductor to which said flat conductor is connected, said housing base member being fastened to said panel component upper surface.

9. A connector arrangement as defined in claim 8, wherein said contact screw is arranged generally vertically and orthogonally relative to said panel component upper surface.

10. A connector arrangement as defined in claim 8, wherein said contact screw is arranged at an acute angle relative to said panel member upper surface.

11. A connector arrangement as defined in claim 8, wherein said electrical panel component is a solar panel.

12. A connector arrangement as defined in claim 8, wherein said electrical panel component is a printed circuit board.

13. A connector arrangement as defined in claim 5, wherein said housing cover section contains a second bore (10) in collinear alignment with said first bore, said contact screw being threadably connected with said second bore, said contact screw having a first end (15) that is adjacent and spaced from said bus bar and flat conductor engagement portions when said contact screw is in said retracted position.

14. A connector arrangement as defined in claim 13, wherein said contact screw is formed from a conductive copper alloy; and further wherein said contact screw first end is pointed, thereby to permit penetration of said contact screw through said flat conductor engagement portion.

15. A connector arrangement as defined in claim 14, wherein said bus bar engagement portion contains a pilot opening (16) arranged in alignment with said first and second bore holes.

16. A connector arrangement as defined in claim 14, wherein the end of said housing cover section second bore remote from said base member is counterbored to define a horizontal support seat (18), said contact screw having a second end (13) that is enlarged and in contact with said support seat when said contact screw is in said connected position.

17. A connector arrangement as defined in claim 5, wherein said bus bar includes a contact portion that (8, 8', 8", 8''') that extends outwardly of said cover member via an opening (P, P', P", P''') contained in said housing cover member.

18. A connector arrangement as defined in claim 5, wherein said flat conductor includes a horizontal first portion (7*a*, 7*a*', 7*a*", 7*a*''') that extends outwardly of said housing.

19. A connector arrangement as defined in claim 18, wherein said flat conductor first portion (7*a*, 7*a*') comprises said engagement portion.

20. A connector arrangement as defined in claim 18, wherein said flat conductor has a second portion (7*b*", 7*b*''') that extends angularly at an obtuse angle relative to said flat conductor first portion, said flat conductor second portion comprising said flat conductor engagement portion; and further wherein said bus bar component includes an inclined third portion (5", 5''') that is parallel with said flat conductor second portions and define said bus bar engagement portion.

* * * * *